US009845710B2

(12) United States Patent
Ichinose et al.

(10) Patent No.: US 9,845,710 B2
(45) Date of Patent: Dec. 19, 2017

(54) START-UP METHOD OF STEAM TURBINE PLANT

(71) Applicant: Kabushiki Kaisha Toshiba, Minato-ku (JP)

(72) Inventors: Mai Ichinose, Yokohama (JP); Hiroyuki Tao, Kawasaki (JP); Atsuo Kinoshita, Ota (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 517 days.

(21) Appl. No.: 14/509,136

(22) Filed: Oct. 8, 2014

(65) Prior Publication Data

US 2015/0113988 A1 Apr. 30, 2015

(30) Foreign Application Priority Data

Oct. 24, 2013 (JP) ..... 2013-221204

(51) Int. Cl.
*F01K 7/02* (2006.01)
*F01K 13/02* (2006.01)
*F01K 7/16* (2006.01)

(52) U.S. Cl.
CPC ..... *F01K 7/025* (2013.01); *F01K 7/16* (2013.01); *F01K 13/02* (2013.01)

(58) Field of Classification Search
CPC ... F01K 7/025; F01K 7/16; F01K 7/22; F01K 3/22; F01K 3/245; F01K 3/265;
(Continued)

(56) References Cited

U.S. PATENT DOCUMENTS 5,038,568 A * 8/1991 Gounder ..... F01K 7/22 60/663
5,109,665 A * 5/1992 Hoizumi ..... F01K 23/101 122/7 R
(Continued)

FOREIGN PATENT DOCUMENTS

EP 2 157 290 A1 2/2010
EP 2 390 476 A1 11/2011
(Continued)

OTHER PUBLICATIONS

Notice of Allowance dated Nov. 22, 2016 in Japanese Patent Application No. 2013-221204 (with unedited computer generated English translation).
(Continued)

*Primary Examiner* — Mark Laurenzi
*Assistant Examiner* — Mickey France
(74) *Attorney, Agent, or Firm* — Oblon, McClelland, Maier & Neustadt, L.L.P.

(57) ABSTRACT

A start-up method of a steam turbine plant includes a first step and a second step. The first step is performed at an aeration start time. In the first step, a reheat steam pressure of an aeration boiler is set to be a reheat steam pressure required by a steam turbine or less. Besides, a reheat steam pressure of a standby boiler is set to be a reheat steam pressure required for the standby boiler or more. The second step is performed when a load of the steam turbine becomes a predetermined value. In the second step, the reheat steam pressure of the aeration boiler is increased to the same degree as the reheat steam pressure of the standby boiler. After that, steam from the aeration boiler and steam from the standby boiler are merged to be supplied to the steam turbine.

4 Claims, 2 Drawing Sheets

(58) Field of Classification Search
CPC ..... F01K 13/02; F01D 19/00; F01D 25/10; F22B 35/14; F22B 35/008; F22D 5/36
USPC ..... 60/645, 646, 653, 656, 670, 676, 677, 60/679, 680
See application file for complete search history.

(56) References Cited

U.S. PATENT DOCUMENTS

| | | | | |
|---|---|---|---|---|
| 5,181,381 | A | 1/1993 | Gounder | |
| 5,347,814 | A * | 9/1994 | Kemmer | F01K 7/22 60/676 |
| 7,987,675 | B2 | 8/2011 | Panchatsaram et al. | |

FOREIGN PATENT DOCUMENTS

| | | |
|---|---|---|
| JP | 2001-317304 | 11/2001 |
| JP | 2004-169625 A | 6/2004 |
| JP | 2004-245184 A | 9/2004 |
| JP | 2007-46577 | 2/2007 |
| JP | 2009-293871 | 12/2009 |
| JP | 2010-106835 | 5/2010 |

OTHER PUBLICATIONS

Office Action dated Jan. 18, 2016 in Korean Patent Application No. 10-2014-0142486 with Partial unedited computer generated English translation.

* cited by examiner

START-UP METHOD OF STEAM TURBINE PLANT

CROSS-REFERENCE TO RELATED APPLICATION

This application is based upon and claims the benefit of priority from Japanese Patent Application No. 2013-221204, filed on Oct. 24, 2013; the entire contents of which are incorporated herein by reference.

FIELD

Embodiments described herein relate generally to a start-up method of a steam turbine plant.

BACKGROUND

Conventionally, one including plural boilers for a single steam turbine is known as a steam turbine plant. Besides, one including a superheater and a reheater is known as the boiler of the steam turbine plant. As for the steam turbine plant as stated above, a steam flow rate required by a steam turbine is small from an aeration start for the steam turbine at a start-up until reaching a predetermined load. Accordingly, steam is supplied from a part of the boilers to the steam turbine from the aeration start for the steam turbine until reaching the predetermined load. Hereinafter, a part of the boilers supplying the steam to the steam turbine at the aeration start time is referred to as an aeration boiler. Besides, a remaining boiler which does not supply the steam to the steam turbine at the aeration start time is referred to as a standby boiler.

After reaching the predetermined load, steam of the standby boiler is merged with steam of the aeration boiler, and supplied to the steam turbine (Tie-in). Conventionally, steam pressures (reheat steam pressures) supplied from the reheaters of the aeration boiler and the standby boiler at the Tie-in time are coincident. There is a problem as described below in a conventional technology as stated above.

For example, a bypass pipe guiding reheat steam from the standby boiler to a steam condenser is provided at a boiler side so that the reheat steam from the standby boiler is not supplied to the steam turbine. The reheat steam pressure of the standby boiler is set to be rather high from the aeration start time so that a valve capacity of a bypass valve provided in a middle of the bypass pipe does not become large. Besides, the reheat steam pressure of the aeration boiler is set to be high in response to the standby boiler.

However, at a steam turbine side, a windage loss is easy to occur because a high-pressure turbine is not able to work sufficiently at the aeration start time. In particular, when a steam pressure in a vicinity of a final stage is high, a temperature of a blade of the final stage is easy to increase exceeding an allowance together with the windage loss. Accordingly, there is a possibility of an occurrence of a serious trouble such as a contact between the blade and a static part.

The steam from the high-pressure turbine has been bypassed to the steam condenser up to now so as to satisfy a requirement of the steam turbine side while satisfying the requirement of the boiler side. For example, a bypass pipe is provided from a middle of a low-temperature reheat steam pipe connected to an outlet of the high-pressure turbine to be connected to the steam condenser. However, it is preferable to satisfy the requirements of the boiler side and the steam turbine side without providing an additional bypass pipe as stated above. Specifically, it is preferable to suppress the windage loss and a temperature increase at the high-pressure turbine while making the valve capacity small.

Besides, when the reheat steam pressures of both the aeration boiler and the standby boiler are set to be high, a fuel consumption amount becomes large. Accordingly, it is required to start-up the steam turbine plant without setting the reheat steam pressures of the aeration boiler and the standby boiler high.

As stated above, it is required to suppress the valve capacity of the bypass valve provided at the bypass pipe connecting the standby boiler and the steam condenser as for the conventional steam turbine plant. Besides, to suppress the valve capacity, it is required not to provide the additional bypass pipe. Further, to suppress the valve capacity, it is required to suppress the fuel consumption amount.

DETAILED DESCRIPTION

In one embodiment, a start-up method of a steam turbine plant is a start-up method of a steam turbine plant including a steam turbine and plural boilers. The steam turbine includes a high-pressure turbine and an intermediate-pressure turbine. The plural boilers each have a superheater and a reheater. The superheater supplies high-pressure steam to the high-pressure turbine. The reheater reheats exhaust steam of the high-pressure turbine, and supplies to the intermediate-pressure turbine as reheat steam.

The start-up method of the steam turbine plant includes a first step and a second step.

The first step is performed at an aeration start time. In the first step, one of the plural boilers is set to be an aeration boiler which supplies steam to a steam turbine. Besides, in the first step, the other of the plural boilers is set to be a standby boiler which does not supply the steam to the steam turbine. A reheat steam pressure of the aeration boiler is set to be a reheat steam pressure required by the steam turbine or less. Besides, a reheat steam pressure of the standby boiler is set to be a reheat steam pressure required for the standby boiler or more.

The second step is performed after the aeration starts, when a load of the steam turbine becomes a predetermined value. In the second step, the reheat steam pressure of the aeration boiler is increased to a degree as same as the reheat steam pressure of the standby boiler. Then, steam from the aeration boiler and steam from the standby boiler are merged, and the merged steam is supplied to the steam turbine.

Hereinafter, embodiments of the present invention are described with reference to the drawings.

Figure 1:
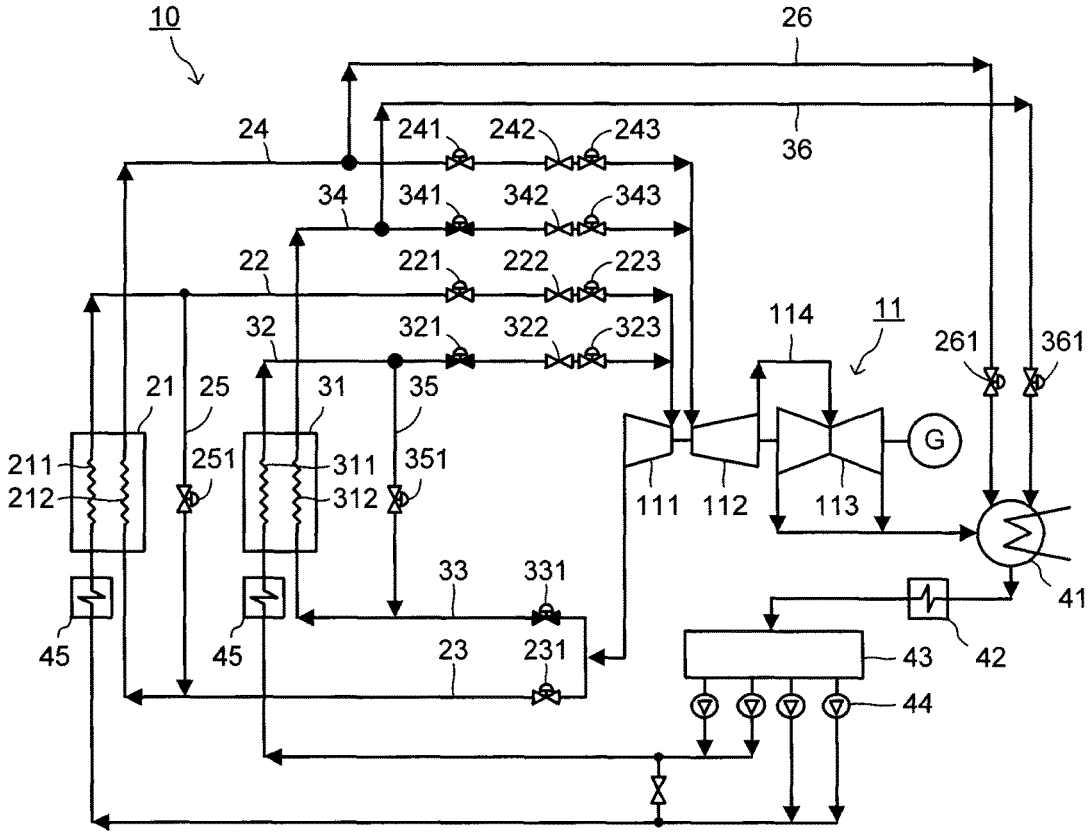
FIG. 1 is a system diagram illustrating a steam turbine plant according to an embodiment.

FIG. 1 is a system diagram illustrating a steam turbine plant of an embodiment. A steam turbine plant 10 of the embodiment includes a single steam turbine 11. The steam turbine 11 includes, for example, a high-pressure turbine 111, an intermediate-pressure turbine 112, and a low-pressure turbine 113. Besides, the steam turbine plant 10 of the embodiment includes, for example, a boiler 21, a boiler 31, and a steam condenser 41.

The boiler 21 includes a superheater 211 and a reheater 212. An outlet of the superheater 211 and an inlet of the high-pressure turbine 111 are connected by a main steam pipe 22 where a main steam separation valve 221, a main steam stop valve 222, and a steam control valve 223 are provided in sequence from the superheater 211 side. An outlet of the high-pressure turbine 111 and an inlet of the reheater 212 are connected by a low-temperature reheat steam pipe 23 where a low-temperature reheat steam separation valve 231 is provided. An outlet of the reheater 212 and an inlet of the intermediate-pressure turbine 112 are connected by a reheat steam pipe 24 where a reheat steam separation valve 241, a reheat steam stop valve 242, and an intercept valve 243 are provided in sequence from the reheater 212 side.

Besides, a high-pressure turbine bypass pipe 25 is provided so as to branch from an upstream side of the main steam separation valve 221 at the main steam pipe 22 to be connected to a downstream side of the low-temperature reheat steam separation valve 231 at the low-temperature reheat steam pipe 23. A high-pressure turbine bypass valve 251 is provided in a middle of the high-pressure turbine bypass pipe 25. Further, an intermediate-low-pressure turbine bypass pipe 26 is provided so as to branch from an upstream side of the reheat steam separation valve 241 at the reheat steam pipe 24 to be connected to the steam condenser 41. An intermediate-low-pressure turbine bypass valve 261 is provided in a middle of the intermediate-low-pressure turbine bypass pipe 26.

Similarly, the boiler 31 includes a superheater 311 and a reheater 312. An outlet of the superheater 311 and the inlet of the high-pressure turbine 111 are connected by a main steam pipe 32 where a main steam separation valve 321, a main steam stop valve 322, and a steam control valve 323 are provided in sequence from the superheater 311 side. The outlet of the high-pressure turbine 111 and an inlet of the reheater 312 are connected by a low-temperature reheat steam pipe 33 where a low-temperature reheat steam separation valve 331 is provided. An outlet of the reheater 312 and the inlet of the intermediate-pressure turbine 112 are connected by a reheat steam pipe 34 where a reheat steam separation valve 341, a reheat steam stop valve 342, and an intercept valve 343 are provided in sequence from the reheater 312 side.

Besides, a high-pressure turbine bypass pipe 35 is provided so as to branch from an upstream side of the main steam separation valve 321 at the main steam pipe 32 to be connected to a downstream side of the low-temperature reheat steam separation valve 331 at the low-temperature reheat steam pipe 33. A high-pressure turbine bypass valve 351 is provided in a middle of the high-pressure turbine bypass pipe 35. Further, an intermediate-low-pressure turbine bypass pipe 36 is provided so as to branch from an upstream side of the reheat steam separation valve 341 at the reheat steam pipe 34 to be connected to the steam condenser 41. An intermediate-low-pressure turbine bypass valve 361 is provided in a middle of the intermediate-low-pressure turbine bypass pipe 36.

Further, an outlet of the intermediate-pressure turbine 112 and an inlet of the low-pressure turbine 113 are connected by a crossover pipe 114. An outlet of the low-pressure turbine 113 is connected to the steam condenser 41, and steam exhausted from the low-pressure turbine 113 is condensed to be condensed water. This condensed water is guided to a low-pressure feedwater heater 42, and a deaerator 43 in sequence. After that, the condensed water is pressurized by a boiler feedwater pump 44, and thereafter, is supplied to the superheater 211 and the superheater 311 via a high-pressure feedwater heater 45.

Besides, control units and so on of each of valves are provided according to need though they are not illustrated. The control unit includes a processing device, an input/output processing device, a storage device, and so on. The control unit is electrically connected to a detecting device and so on detecting each valve and an operation state. As the detecting device, for example, a device detecting a temperature of components of the steam turbine 11, a device detecting an opening degree of each valve, a device detecting a rotation speed of the steam turbine 11, a device detecting a load, a device detecting a flow rate of steam, a device detecting a pressure of steam, a device detecting a system frequency, a voltage, and a phase when an electric power system is also turned on, and so on can be cited.

When the steam turbine plant 10 is started, the main steam separation valve 321 of the main steam pipe 32, the low-temperature reheat steam separation valve 331 of the low-temperature reheat steam pipe 33, and the reheat steam separation valve 341 of the reheat steam pipe 34 are closed from an aeration start time to a predetermined load time, and thereby, it is possible to set the boiler 31 as the standby boiler which does not supply steam to the steam turbine 11. On the other hand, the main steam separation valve 221 of the main steam pipe 22, the low-temperature reheat steam separation valve 231 of the low-temperature reheat steam pipe 23, and the reheat steam separation valve 241 of the reheat steam pipe 24 are opened, and thereby, it is possible to set the boiler 21 as the aeration boiler which supplies steam to the steam turbine 11.

A part of the steam generated at the boiler 21 and the boiler 31 is supplied to the steam turbine 11 according to need. Excessive steam which is not supplied to the steam turbine 11 is collected by the steam condenser 41 via the high-pressure turbine bypass pipe 25 and the high-pressure turbine bypass pipe 35, further the intermediate-low-pressure turbine bypass pipe 26 and the intermediate-low-pressure turbine bypass pipe 36.

Further, the intermediate-low-pressure turbine bypass valve 361 of the intermediate-low-pressure turbine bypass pipe 36 is adjusted, and thereby, it is possible to adjust the reheat steam pressure of the boiler 31 to be the standby boiler. Similarly, the intermediate-low-pressure turbine bypass valve 261 of the intermediate-low-pressure turbine bypass pipe 26 is adjusted, and thereby, it is possible to adjust the reheat steam pressure of the boiler 21 to be the aeration boiler.

As stated above, the main steam separation valve, the low-temperature reheat steam separation valve, the reheat steam separation valve, the high-pressure turbine bypass valve, the intermediate-low-pressure turbine bypass valve, and so on are provided by each boiler, and thereby, it is possible to independently adjust a steam supply and the reheat steam pressure by each boiler.

Figure 2:
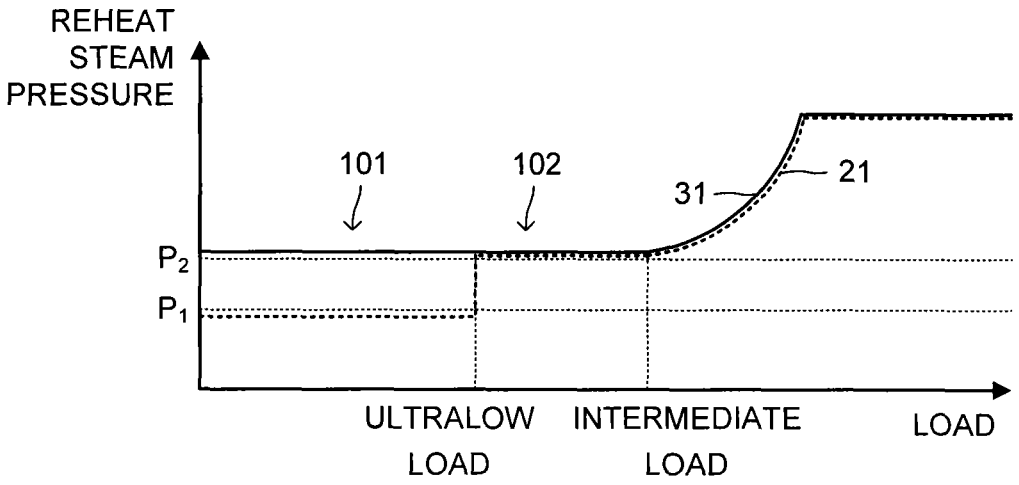
FIG. 2 is a view illustrating a relationship between a load of a steam turbine and reheat steam pressures of an aeration boiler and a standby boiler in a start-up method of the steam turbine plant according to a first embodiment.

Next, a start-up method of a steam turbine plant according to a first embodiment is described. FIG. 2 is a view illustrating a relationship between a load of the steam turbine 11 in the start-up method of the first embodiment and the reheat steam pressures of the boiler 21 to be the aeration boiler and the boiler 31 to be the standby boiler.

Hereinafter, the steam turbine plant 10 of the embodiment, namely, a case of the steam turbine plant 10 including the boiler 21 to be the aeration boiler and the boiler 31 to be the standby boiler is exemplified to be described.

The start-up method of the steam turbine plant of the first embodiment includes a first step 101 and a second step 102.

The first step 101 is performed at an aeration start time. In the first step 101, the boiler 21 is set to be the aeration boiler which supplies the steam to the steam turbine 11. Besides, in the first step 101, the boiler 31 is set to be the standby boiler which does not supply the steam to the steam turbine 11. The reheat steam pressure of the boiler 21 being the aeration boiler is set to be a reheat steam pressure ($P_1$) required by the steam turbine 11 or less. Besides, the reheat steam pressure of the boiler 31 being the standby boiler is set to be a reheat steam pressure ($P_2$) required for the standby boiler or more as same as the conventional art. Namely, the reheat steam pressure of the boiler 31 being the standby boiler is the predetermined reheat steam pressure ($P_2$) or more in which the valve capacity of the intermediate-low-pressure turbine bypass valve 361 does not become large. Note that, the reheat steam pressure ($P_1$) is normally smaller than the reheat steam pressure ($P_2$) ($P_1<P_2$).

The second step 102 is performed after the aeration starts, when the load of the steam turbine 11 becomes a predetermined value. In the second step 102, a heat steam pressure of the boiler 21 being the aeration boiler is increased to the same degree as the reheat steam pressure of the boiler 31 being the standby boiler. After that, each steam of the boilers 21, 31 is merged, and the merged steam is supplied to the steam turbine 11. Here, as the steam supplied to the steam turbine 11, main steam being high-pressure steam and reheat steam can be cited.

In the start-up method of the first embodiment, the reheat steam pressure of the boiler 31 being the standby boiler is set to be the predetermined reheat steam pressure ($P_2$) or more at the first step 101. The boiler 31 is set to be the reheat steam pressure ($P_2$) or more, and thereby, it is possible to suppress the valve capacity of the intermediate-low-pressure turbine bypass valve 361.

Besides, in the start-up method of the first embodiment, the reheat steam pressure of the boiler 21 being the aeration boiler is set to be low such as the reheat steam pressure ($P_1$) required by the steam turbine 11 or less at the first step 101. The reheat steam pressure of the boiler 21 is set to be the reheat steam pressure ($P_1$) or less, and thereby, a steam pressure at a final stage of the high-pressure turbine 111 is able to be set low. The steam pressure at the final stage of the high-pressure turbine 111 is able to be set low, and therefore, it is not necessary to provide an equipment to release the steam at the final stage to the steam condenser as in the conventional art. Namely, it is not necessary to provide an equipment to release the steam from the low-temperature reheat steam pipe 23 to the steam condenser 41. It is possible to suppress the windage loss at the high-pressure turbine 111 without providing the equipment as stated above. Namely, it is possible to suppress the windage loss at the high-pressure turbine 111 without providing a pipe connecting the low-temperature reheat steam pipe 23 and the steam condenser 41.

Specifically, the reheat steam pressure of the boiler 21 being the aeration boiler is set low, and thereby, it is possible to suppress a pressure at an exhaust hood of the high-pressure turbine 111. It is thereby possible to suppress the windage loss, and as a result, it is possible to keep a temperature increase at the final stage of the high-pressure turbine 111 within an allowance.

Further, the boiler 21 is set to be the reheat steam pressure ($P_1$) or less, and thereby, it is possible to suppress the fuel consumption amount compared to a conventional start-up method of a steam turbine plant. Note that in the conventional start-up method of the steam turbine plant, the reheat steam pressures of both the aeration boiler and the standby boiler are set high to be the reheat steam pressure ($P_2$) or more.

Here, the reheat steam pressure ($P_1$) required by the steam turbine 11 may be one capable of suppressing the windage loss at the high-pressure turbine 111. The reheat steam pressure ($P_1$) required by the steam turbine 11 is preferably approximately 10 bar though it may be slightly different depending on a concrete configuration of the steam turbine 11.

On the other hand, the reheat steam pressure ($P_2$) of the boiler 31 being the standby boiler may be the reheat steam pressure or more in which the valve capacity of the intermediate-low-pressure turbine bypass valve 361 does not become large. Here, to lower the valve capacity of the intermediate-low-pressure turbine bypass valve 361, the reheat steam pressure ($P_2$) is preferably larger. However, when the reheat steam pressure ($P_2$) is too large, there is a possibility in which a temperature of the exhaust hood becomes too high caused by the windage loss when the reheat steam pressure of the boiler 21 being the aeration boiler is increased to the pressure in the second step. From a point of view as stated above, the reheat steam pressure ($P_2$) is preferably determined appropriately in accordance with a concrete mode of the steam turbine plant. In particular, the reheat steam pressure ($P_2$) is preferably determined appropriately by considering while comparing reduction in the valve capacity and the suppression of the temperature of the exhaust hood caused by the windage loss.

The first step 101 is performed as follows. Namely, as for the boiler 21 being the aeration boiler, the main steam separation valve 221, the main steam stop valve 222, and the steam control valve 223 of the main steam pipe 22, the low-temperature reheat steam separation valve 231 of the low-temperature reheat steam pipe 23, the reheat steam separation valve 241, the reheat steam stop valve 242, and the intercept valve 243 of the reheat steam pipe 24 are opened. Further, the high-pressure turbine bypass valve 251 of the high-pressure turbine bypass pipe 25 and the intermediate-low-pressure turbine bypass valve 261 of the intermediate-low-pressure turbine bypass pipe 26 are opened. The steam is thereby supplied to the steam turbine 11 while a steam amount from the boiler 21 is adjusted to an amount necessary for the aeration of the steam turbine 11 by a control of each valve.

On the other hand, as for the boiler 31 being the standby boiler, the main steam separation valve 321 of the main steam pipe 32, the low-temperature reheat steam separation valve 331 of the low-temperature reheat steam pipe 33, and the reheat steam separation valve 341 of the reheat steam pipe 34 are closed. It is thereby possible to set the boiler 31 to be the standby boiler which does not supply the steam to the steam turbine 11. Note that the main steam stop valve 322 and the steam control valve 323 of the main steam pipe 32, and the reheat steam stop valve 342 and the intercept valve 343 of the reheat steam pipe 34 may each be opened, or closed. Besides, the high-pressure turbine bypass valve 351 of the high-pressure turbine bypass pipe 35 and the intermediate-low-pressure turbine bypass valve 361 of the intermediate-low-pressure turbine bypass pipe 36 are opened. All of the steam from the boiler 31 is thereby supplied to the steam condenser 41 without being used for the aeration of the steam turbine 11 at all.

At this time, for example, it is possible to adjust the reheat steam pressure of the boiler 21 being the aeration boiler by adjusting the intermediate-low-pressure turbine bypass valve 261 of the intermediate-low-pressure turbine bypass pipe 26. Besides, for example, it is possible to adjust the reheat steam pressure of the boiler 31 being the standby boiler by adjusting the intermediate-low-pressure turbine bypass valve 361 of the intermediate-low-pressure turbine bypass pipe 36. Specifically, it is possible to make the reheat steam pressure of the boiler 21 being the aeration boiler low by adjusting a valve opening degree of the intermediate-low-pressure turbine bypass valve 261 of the intermediate-low-pressure turbine bypass pipe 26 in a direction to make it large. On the other hand, it is possible to increase the reheat steam pressure of the boiler 31 being the standby boiler by adjusting the valve opening degree of the intermediate-low-pressure turbine bypass valve 361 of the intermediate-low-pressure turbine bypass pipe 36 in a direction to make it small.

The second step 102 is performed as described below. Namely, the valve opening degree of the intermediate-low-pressure turbine bypass valve 261 of the intermediate-low-pressure turbine bypass pipe 26 is set to be small compared to the valve opening degree of the first step 101. The reheat steam pressure of the boiler 21 being the aeration boiler is thereby increased to the same degree as the reheat steam pressure of the boiler 31 being the standby boiler. Besides, the main steam separation valve 321 of the main steam pipe 32, the low-temperature reheat steam separation valve 331 of the low-temperature reheat steam pipe 33, and the reheat steam separation valve 341 of the reheat steam pipe 34 are opened. The steam from the boiler 31 being the standby boiler and the steam from the boiler 21 are thereby made into a state in which the pressures thereof are the same to be merged, and the merged steam is supplied to the steam turbine 11. After that, steam conditions of the aeration boiler and the standby boiler are set to be the same, and a load is increased.

The first step 101 is preferably performed from the aeration start time for the steam turbine 11 to an ultralow load reaching time. Here, the aeration start time is a moment when first steam is supplied to the steam turbine 11. Besides, the ultralow load reaching time is a time when a load of the steam turbine 11 relative to a rated load is any of 10% or more and less than 30%, for example, 20%.

A pressurization performed at the beginning of the second step 102 is preferably performed at a constant load after the ultralow load reaching time. The load at the pressurization time is made constant, and thereby, it is possible to make controllability fine. Besides, the second step 102 is preferably performed until an intermediate load reaching time. Namely, as for the boiler 21 being the aeration boiler, the pressurization performed at the beginning of the second step 102 is preferably performed under a constant load. Besides, as for the boiler 21 being the aeration boiler, after the steam is merged with the steam of the boiler 31 being the standby boiler and supplied to the steam turbine 11, it is preferable that the reheat steam pressure is kept until the intermediate load reaching time. Besides, as for the boiler 31 being the standby boiler, the reheat steam pressure (similar to the reheat steam pressure of the first step 101) at the beginning of the second step 102 is preferably kept until the intermediate load reaching time. Here, the intermediate load reaching time is a time when the load of the steam turbine 11 relative to the rated load becomes any of 30% or more and 60% or less, for example, 50%.

After the second step 102, for example, the reheat steam pressure of the boiler 21 being the aeration boiler is gradually increased in accordance with an increase of the load of the steam turbine 11. Similarly, after the second step 102, for example, the reheat steam pressure of the boiler 31 being the standby boiler is gradually increased in accordance with an increase of the load of the steam turbine 11. At this time, for example, the reheat steam pressure of the boiler 21 being the aeration boiler and the reheat steam pressure of the boiler 31 being the standby boiler are gradually increased such that they become the same degree with each other.

After the steam turbine becomes a predetermined load, for example, until the load of the steam turbine 11 reaches the rated load, the reheat steam pressure of the boiler 21 being the aeration boiler is made constant. Similarly, after the steam turbine becomes the predetermined load, for example, until the load of the steam turbine 11 reaches the rated load, the reheat steam pressure of the boiler 31 being the standby boiler is made constant.

Figure 3:
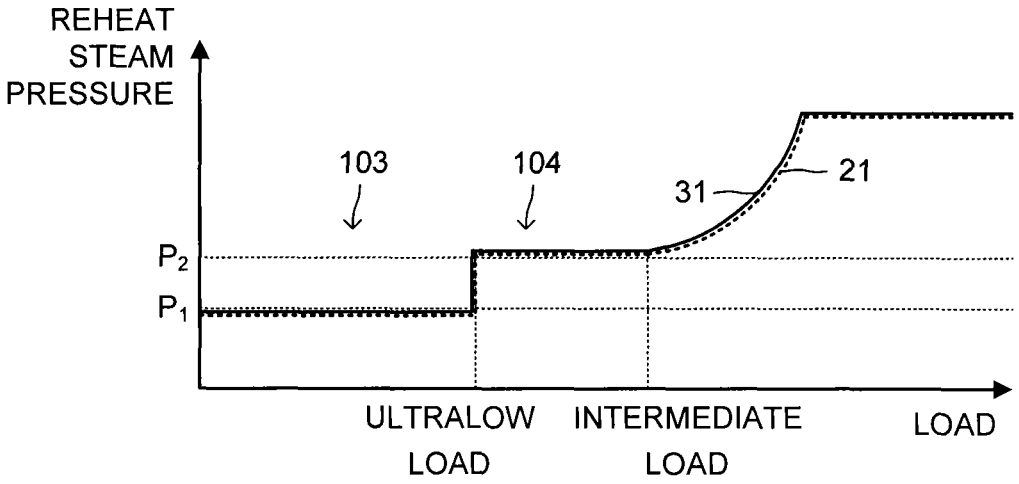
FIG. 3 is a view illustrating a relationship between a load of a steam turbine and reheat steam pressures of an aeration boiler and a standby boiler in a start-up method of the steam turbine plant according to a second embodiment.

Next, a start-up method of the steam turbine plant of a second embodiment is described. FIG. 3 is a view illustrating a relationship between the load of the steam turbine 11 in the start-up method of the second embodiment and the reheat steam pressures of the boiler 21 to be the aeration boiler and the boiler 31 to be the standby boiler.

The start-up method of the steam turbine plant of the second embodiment includes a first step 103 and a second step 104.

The first step 103 is performed at the aeration start time. In the first step 103, the boiler 21 is set to be the aeration boiler which supplies the steam to the steam turbine 11, and the boiler 31 is set to be the standby boiler which does not supply the steam to the steam turbine 11. Besides, in the first step 103, the reheat steam pressures of the boiler 21 being the aeration boiler and the boiler 31 being the standby boiler are each independently set to be the reheat steam pressure ($P_1$) or less. Namely, the reheat steam pressures of the boiler 21, the boiler 31 may be the reheat steam pressure ($P_1$) or less, and they may be different from one another. The steam is supplied to the steam turbine 11 only from the boiler 21 being the aeration boiler.

The second step 104 is performed after the aeration starts, when the load of the steam turbine 11 becomes the predetermined value. In the second step 104, the reheat steam pressures of the boiler 21 being the aeration boiler and the boiler 31 being the standby boiler are each independently increased to the reheat steam pressure ($P_2$) or more. At this time, the reheat steam pressures of the boiler 21, the boiler 31 are preferably the reheat steam pressures at the same degree with each other. After that, the steam of both boilers are merged, and the merged steam is supplied to the steam turbine 11.

In the start-up method of the second embodiment, the reheat steam pressure of the boiler 21 being the aeration boiler is set to be low at the first step 103. The reheat steam pressure of the boiler 21 is low, and therefore, it is possible to set a steam pressure at the final stage of the high-pressure turbine 111 low. The steam pressure at the final stage of the high-pressure turbine 111 can be set low, and therefore, it is not necessary to provide the equipment to release the steam at the final stage to the steam condenser as in the conventional art. Namely, it is not necessary to provide the equipment to release the steam from the low-temperature reheat steam pipe 23 to the steam condenser 41. It is possible to suppress the windage loss at the high-pressure turbine 111 without providing the equipment as stated above. Namely, it is possible to suppress the windage loss at the high-pressure turbine 111 without providing the pipe connecting the low-temperature reheat steam pipe 23 and the steam condenser 41. Besides, in the start-up method of the second embodiment, the reheat steam pressure of the boiler 31 being the standby boiler is set low at the first step 103. The reheat steam pressure of the boiler 31 is low, and therefore, the fuel consumption amount is further suppressed compared to the start-up method of the first embodiment.

Note that in the first step 103, when the reheat steam pressure of the boiler 31 to be the standby boiler is lowered, it is desirable to set the pressure to a degree in which the valve capacity of the intermediate-low-pressure turbine bypass valve 361 is not affected. Here, the intermediate-low-pressure turbine bypass valve 361 is one provided at the intermediate-low-pressure turbine bypass pipe 36. The intermediate-low-pressure turbine bypass pipe 36 is one to bypass the reheat steam from the boiler 31 to be the standby boiler.

The first step 103 is able to be performed as same as the first embodiment except that the reheat steam pressure of the boiler 31 being the standby boiler is adjusted to be the reheat steam pressure ($P_1$) or less. Namely, opening/closing states of each valve to set the boiler 21 to be the aeration boiler and the boiler 31 to be the standby boiler can be set to be the same as the first embodiment.

Besides, an adjustment of the reheat steam pressure of the boiler 21 being the aeration boiler can be performed by an adjustment of the intermediate-low-pressure turbine bypass valve 261 of the intermediate-low-pressure turbine bypass pipe 26. Besides, an adjustment of the reheat steam pressure of the boiler 31 being the standby boiler can be performed by an adjustment of the intermediate-low-pressure turbine bypass valve 361 of the intermediate-low-pressure turbine bypass pipe 36. Specifically, both the intermediate-low-pressure turbine bypass valve 261 of the intermediate-low-pressure turbine bypass pipe 26 and the intermediate-low-pressure turbine bypass valve 361 of the intermediate-low-pressure turbine bypass pipe 36 are adjusted in a direction in which the valve opening degrees are made large, and thereby, it is possible to lower the reheat steam pressures of the boiler 21 being the aeration boiler and the boiler 31 being the standby boiler.

The second step 104 is performed as, for example, described below. Namely, the valve opening degree of the intermediate-low-pressure turbine bypass valve 261 of the intermediate-low-pressure turbine bypass pipe 26 is set to be smaller compared to the case of the first step 103. It is thereby possible to increase the reheat steam pressure of the boiler 21 being the aeration boiler. Similarly, the valve opening degree of the intermediate-low-pressure turbine bypass valve 361 of the intermediate-low-pressure turbine bypass pipe 36 is set to be smaller compared to the case of the first step. It is thereby possible to increase the reheat steam pressure of the boiler 31 being the standby boiler. Further, the main steam separation valve 321 of the main steam pipe 32, the low-temperature reheat steam separation valve 331 of the low-temperature reheat steam pipe 33, and the reheat steam separation valve 341 of the reheat steam pipe 34 are opened. It is thereby possible to merge the steam from the boiler 31 being the standby boiler with the steam from the boiler 21, and to supply the merged steam to the steam turbine 11.

Hereinabove, the start-up methods of the steam turbine plant according to the first and second embodiments are described. A case when two boilers are included is described as for the start-up methods of the steam turbine plant according to the first and second embodiments, but the number of boilers may be three or more. When three or more boilers are included, a boiler to be the aeration boiler or the standby boiler can be selected appropriately.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A start-up method of a steam turbine plant comprising a steam turbine including a high-pressure turbine and an intermediate-pressure turbine; and plural boilers each including a superheater which supplies high-pressure steam to the high-pressure turbine and a reheater which reheats exhaust steam of the high-pressure turbine and supplies the reheat steam to the intermediate-pressure turbine, the plural boilers including an aeration boiler and a standby boiler, the start-up method of the steam turbine plant comprising:

at start time, a first step including:

supplying steam to the steam turbine from the aeration boiler without supplying the steam to the steam turbine from the standby boiler;

controlling a reheat steam pressure of the aeration boiler to be a reheat steam pressure required by the steam turbine or less; and controlling a reheat steam pressure of the standby boiler to be a reheat steam pressure required for the standby boiler or more, and after the start time and when a load of the steam turbine becomes a predetermined value, a second step including:

increasing the reheat steam pressure of the aeration boiler to the same degree as the reheat steam pressure of the standby boiler;

merging the steam from the aeration boiler and the steam from the standby boiler; and supplying the merged steam to the steam turbine.

2. A start-up method of a steam turbine plant comprising a steam turbine including a high-pressure turbine and an intermediate-pressure turbine; and plural boilers each including a superheater which supplies high-pressure steam to the high-pressure turbine and a reheater which reheats exhaust steam of the high-pressure turbine and supplies the reheat steam to the intermediate-pressure turbine, the plural boilers including an aeration boiler and a standby boiler, the start-up method of the steam turbine plant comprising:

at start time, a first step including:

supplying steam to the steam turbine from the aeration boiler without supplying the steam to the steam turbine from the standby boiler; and controlling each of reheat steam pressures of the aeration boiler and the standby boiler to be a reheat steam pressure required by the steam turbine or less independently, and after the start time and when a load of the steam turbine becomes a predetermined value, a second step including:

increasing the reheat steam pressures of the aeration boiler and the standby boiler to a reheat steam pressure required for each boiler or more while setting the reheat steam pressures of both to be the reheat steam pressures at the same degree with each other;

merging the steam from the aeration boiler and the steam from the standby boiler; and supplying the merged steam to the steam turbine.

3. The start-up method of the steam turbine plant of claim 1, wherein the start time includes a time when the steam is first supplied to the steam turbine for starting-up the steam turbine plant.

4. The start-up method of the steam turbine plant of claim 2, wherein the start time includes a time when the steam is first supplied to the steam turbine for starting-up the steam turbine plant.

* * * * *